US005404806A

United States Patent [19]

Proctor

[11] Patent Number: 5,404,806

[45] Date of Patent: Apr. 11, 1995

[54] MULTIPLE FEED CYLINDER PRESS

[75] Inventor: Arthur E. Proctor, Bailey, Mich.

[73] Assignee: BecMar Corp., Bailey, Mich.

[21] Appl. No.: 291,296

[22] Filed: Aug. 16, 1994

Related U.S. Application Data

[62] Division of Ser. No. 104,718, Aug. 11, 1993, Pat. No. 5,372,066.

[51] Int. Cl.[6] ..... B41L 13/00

[52] U.S. Cl. ..... 101/118; 101/232

[58] Field of Search ..... 101/114, 118, 123, 117, 101/232

[56] References Cited

U.S. PATENT DOCUMENTS

| | | | |
|---|---|---|---|
| 2,578,779 | 12/1951 | Black | 271/194 |
| 2,606,492 | 8/1952 | Black | 101/129 |
| 2,866,405 | 12/1958 | Black | 101/123 |
| 3,029,927 | 4/1962 | Farwell | 198/464.4 |
| 3,120,180 | 2/1964 | Black et al. | 101/129 |
| 3,889,595 | 6/1975 | Jaffa | 101/118 |
| 3,889,629 | 6/1975 | Black | 101/114 |
| 4,509,422 | 4/1985 | Nagatani | 101/118 |
| 4,589,335 | 5/1986 | Svantesson | 101/114 |
| 5,235,907 | 8/1993 | Hirata | 101/118 |

*Primary Examiner*—Eugene H. Eickholt
*Attorney, Agent, or Firm*—Price, Heneveld, Cooper, DeWitt & Litton

[57] ABSTRACT

A printing press feeder capable of sheet feeding from the rear, sheet feeding from the front, or stream feeding from the rear, using tracks above a stock support for the feeder, the sheet feeder head being movably mounted on these tracks, and a movable drive connection from a power source to the sheet feeder head for driving of the sheet pickup advancers in the different head positions. The sheet feeder has first and second alternate drive mechanisms, on opposite ends of the transverse drive shaft, the first drive mechanism having a variable speed drive for sheet feeding individual sheets and slowing feed of each sheet as the sheet approaches the print cylinder, and the second drive mechanism having a constant speed drive for stream feeding overlapping sheets to the print cylinder. The press has nonprint lift cylinders engaging the squeegee mount and actuable to lift the squeegee out of print position, but still within the stencil screen frame, to allow the stencil screen frame to cycle without printing. The stencil screen carriage is connected to a drive shaft to be reciprocated, a pinion gear on the drive shaft engaging an elongated gear rack held by a pivotal bearing support, so that rotation of a drive crank will reciprocate the gear rack while rocking it about the pivotal bearing support, to rotatably drive the drive shaft in opposite directions causing rotational reciprocation of the cylinder and linear reciprocation of the carriage.

17 Claims, 17 Drawing Sheets

MULTIPLE FEED CYLINDER PRESS

This is a divisional of application Ser. No. 08/104,718, filed on Aug. 11, 1993, now U.S. Pat. No. 5,372,066.

BACKGROUND OF THE INVENTION

This invention relates to stencil screen printing machines and sheet feeders therefor.

Stencil screen printing machines and sheet feeders therefor have been known for several decades, see, e.g., U.S. Pat. Nos. 2,578,779; 2,606,492; 2,866,405; 3,029,927 and 3,120,180.

In operating these machines, the individual sheets are sometimes fed to the print cylinder and screen frame by what is called "stream feed" and sometimes by what is called "sheet feed." Stream feed means the delivery to the print cylinder of sheets in overlapped relationship. Sheet feed means the delivery to the print cylinder of sheets in separated relationship, i.e., each spaced from the next. Feeding of the sheets is normally with shifting suction units to a feed table over which recirculating belts pass. When sheets are stream fed, the sheets are fed from the rear of the stock board on which the stock of sheets is placed. That is, the top sheet in the shack is pushed at its rear edge toward the feed table, i.e., to the moving belts to advance the sheets to the print cylinder. When sheets are sheet fed, they may be fed by a pusher mounted at the rear of the stock board, i.e., by pushing the rear edge of the sheet, or by a puller mounted at the front of the stock board, i.e., by pulling the front of the sheet. It would be advantageous to have a stencil screen printing machine which could stream feed from the rear, or sheet feed from the front, or sheet feed from the rear, and capable of changeover between these three variations in a quick, easy manner.

Another feature commonly found on stencil screen printing machines is the capacity of the squeegee to be vertically moved between a lowered print position, a slightly raised return, ink flood position, and a high lift position out of the stencil screen frame. In the print position, the squeegee moves over the stencil screen in engagement therewith, to force ink through the screen and onto a sheet of stock held on and moving with the underlying print cylinder. In the return stroke, the flood position is assumed wherein the squeegee is a small fraction of an inch above the screen to be just out of engagement with the screen so as to flood a new layer of ink onto the screen for the next print stroke. High lift of the squeegee is achieved as with a pair of fluid cylinders, gears, or otherwise, which lift the squeegee subassembly completely out of the screen frame so as to allow changes to be made in the squeegee, changes to or removal of the screen frame, cleaning and/or repair of the screen, and the like. When high lift is accomplished by fluid cylinders, these same cylinders have been known to also be used to hold down the squeegee on the stencil screen during the print stroke.

Sometimes a press operator would like to cycle the press through a print stroke to check the print stroke of tile apparatus, but without printing during that stroke. The only way that can presently be attempted is to put the squeegee in high lift condition/position and run tile press through the forward stroke. However, if this is done, the next stroke cannot be effectively used to print because it takes too long for the high lifted squeegee to lower onto the screen, so that the press is already part way through the print stroke by the time the squeegee engages the screen. It would be of significant advantage for a stencil screen printer to have a "nonprint" squeegee position allowing a simulated print cycle of a rapidly moving printer, without actual printing taking place, followed by a full print cycle, as well as having the usual high lift position.

Aside from these above noted shortcomings of conventional stencil screen printing machines, there is another shortcoming or trouble area that involves the print cylinder drive. The print cylinder is rotatably mounted to rotationally oscillate in one rotary direction, and then return in the opposite rotary direction, rapidly and repeatedly. Such a print cylinder is typically rotatably oscillated by having a gear on one end of the cylinder engaging an underlying gear rack mounted in a horizontal slide track below the gear. The gear rack can be oscillated linearly while held securely against vertical and lateral movement, assuring constant full engagement with the gear. However, experience has shown that any small object falling into the gear rack, even small metal shavings, can instantly bind up the drive, score the components and jam the fast moving press to stop it, practically instantaneously, with likely concomitant damage. Significant down time, e.g., several days, also results because the printing apparatus must be substantially disassembled by removal of the squeegee, removal of the print cylinder and other adjacent components to get down to the jammed, damaged gear drive mechanism. It would be highly advantageous to have a dependable print cylinder drive using gear and gear rack components but without the known tendency to be jammed and damaged, causing significant down time and repair costs. Moreover, it would be advantageous to have such a print cylinder drive which is removable and replaceable without having to remove the squeegee subassembly or the print cylinder.

SUMMARY OF THE INVENTION

It is an object of this invention to provide an improved stencil screen printing machine which can stream feed, sheet feed from the front, sheet feed from the rear, and be rapidly changeable between any of these feed conditions. The novel machine can be changed between stream feed and sheet feed by simply deactuating one feeder drive and actuating another feeder drive. It can be changed between front and rear sheet feed by simply advancing the suction feeder head along special tracks, to one position or the other. This feeder head is preferably moved along these tracks by flexible members such as chains on sprockets.

Another object of this invention is to provide a squeegee position control which enables the squeegee to be placed in 1) print position, 2) flood position, 3) high lift position out of the screen frame, and also 4) nonprint position within the screen frame, to allow a rapid nonprint stroke followed by a full print stroke. The squeegee is moved to high lift position out of the screen frame by a pair of conventional fluid cylinders. The print and flood positions are preferably governed by typical cam surfaces, after the conventional fluid cylinders lower the squeegee assembly and hold it down during the print stroke. The nonprint position of the squeegee is achieved by a special separate pair of fluid cylinders which elevate the squeegee subassembly to the nonprint position but still within the screen frame.

Another object of this invention is to provide a unique print cylinder drive which employs a floating rocking gear rack driven by a crank, and engaging a spur gear for driving the print cylinder and the stencil carriage. The drive is not susceptible to jamming with entry of extraneous material. The drive is easy to remove from the machine, without requiring removal of the squeegee subassembly or the print cylinder, enabling rapid repair with minimal downtime. Another object of the invention is to provide such a stencil screen printing machine capable of easy access to the printer underside by power elevation of the feed table and/or pneumatic lowering of the delivery table and the adjacent stripper plate.

These and several other objects, advantages and features of the invention will become apparent to those in the art upon studying the following specification in conjunction with the drawings.

DESCRIPTION OF THE PREFERRED EMBODIMENT

Figure 1:
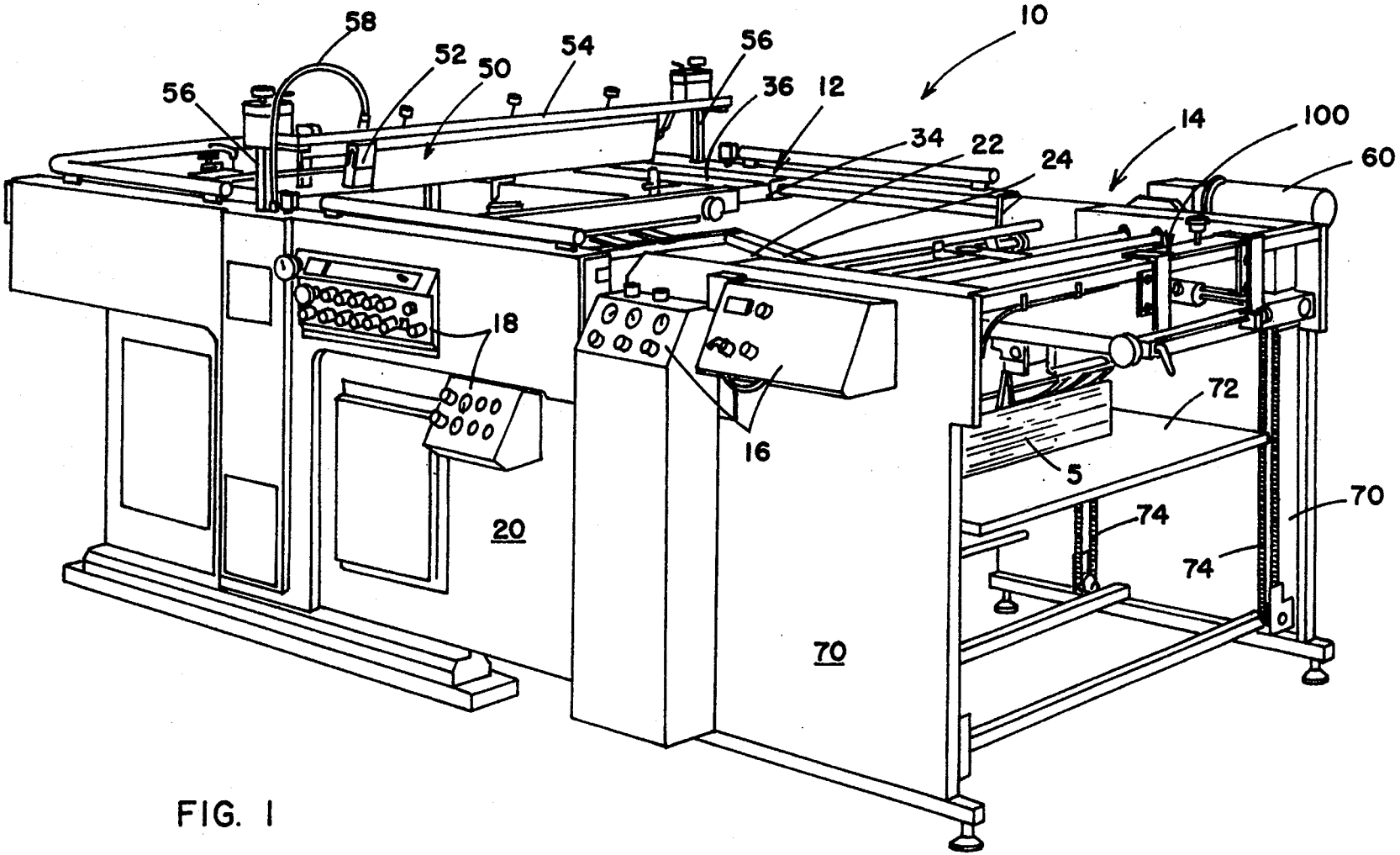
FIG. 1 is a perspective view of the combination stencil screen press and feeder of this invention.

Referring now specifically to the drawings, the stencil screen printing press and feeder assembly 10 (FIG. 1) is composed of the stencil screen press subassembly 12 and the feeder subassembly 14 upstream of the press. These two subassemblies are driven by the same drive mechanism in totally synchronized fashion, as will be apparent from the description to follow.

Figure 19:
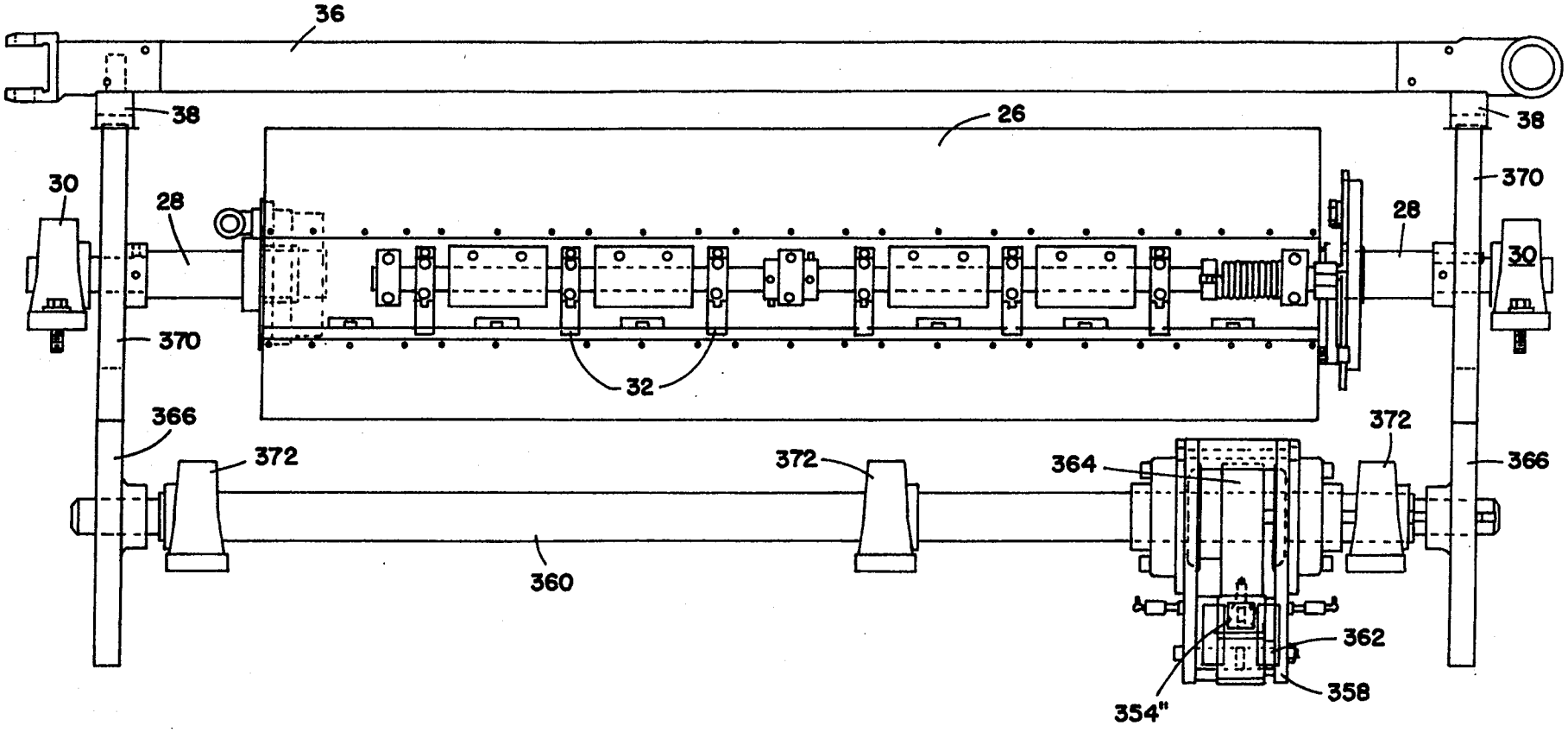
FIG. 19 is an end elevational view of the print cylinder and the drive mechanism for the cylinder and the stencil screen carriage and support frame.
Figure 20:
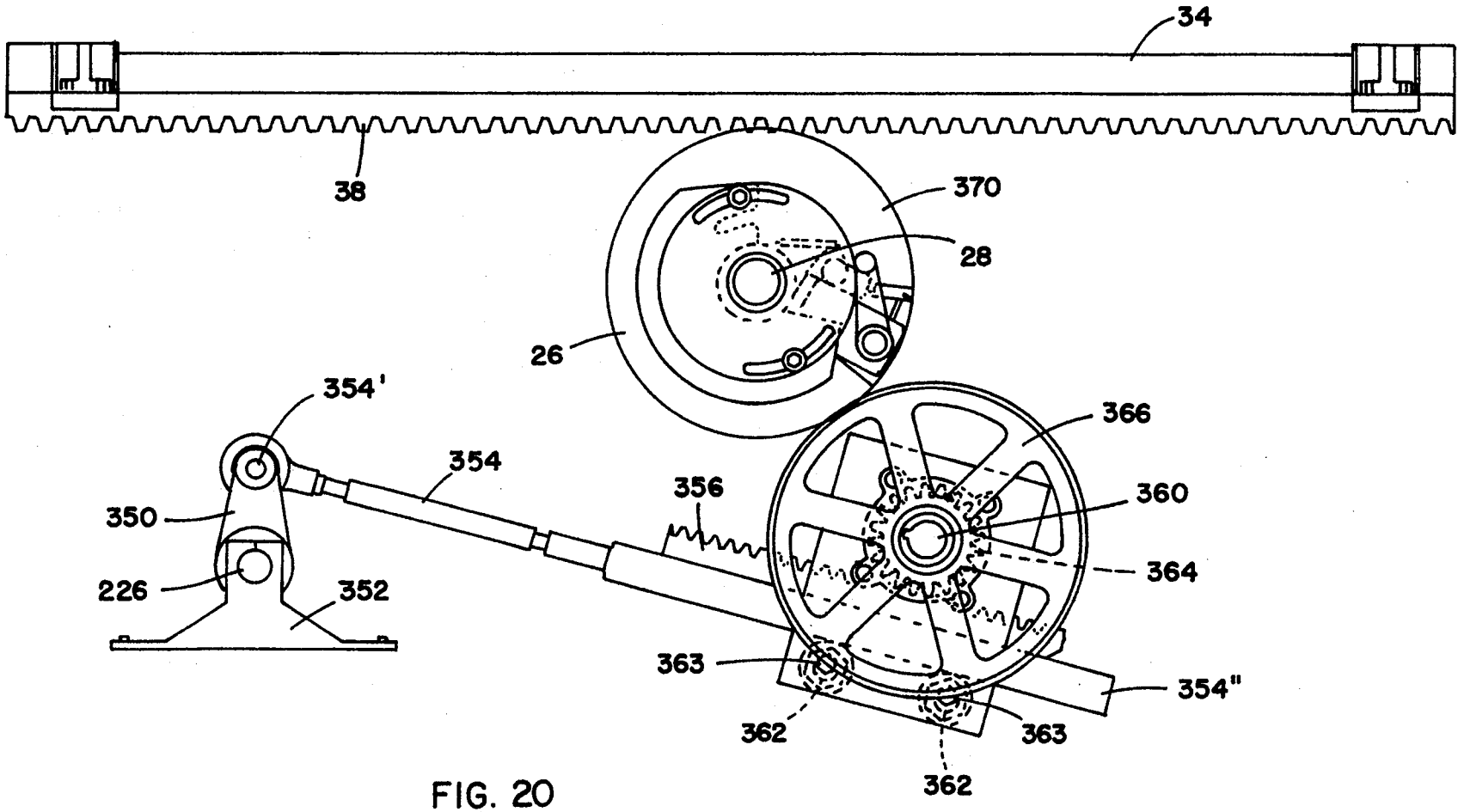
FIG. 20 is an end elevational view of the drive mechanism and print cylinder in FIG. 19.
Figure 20A:
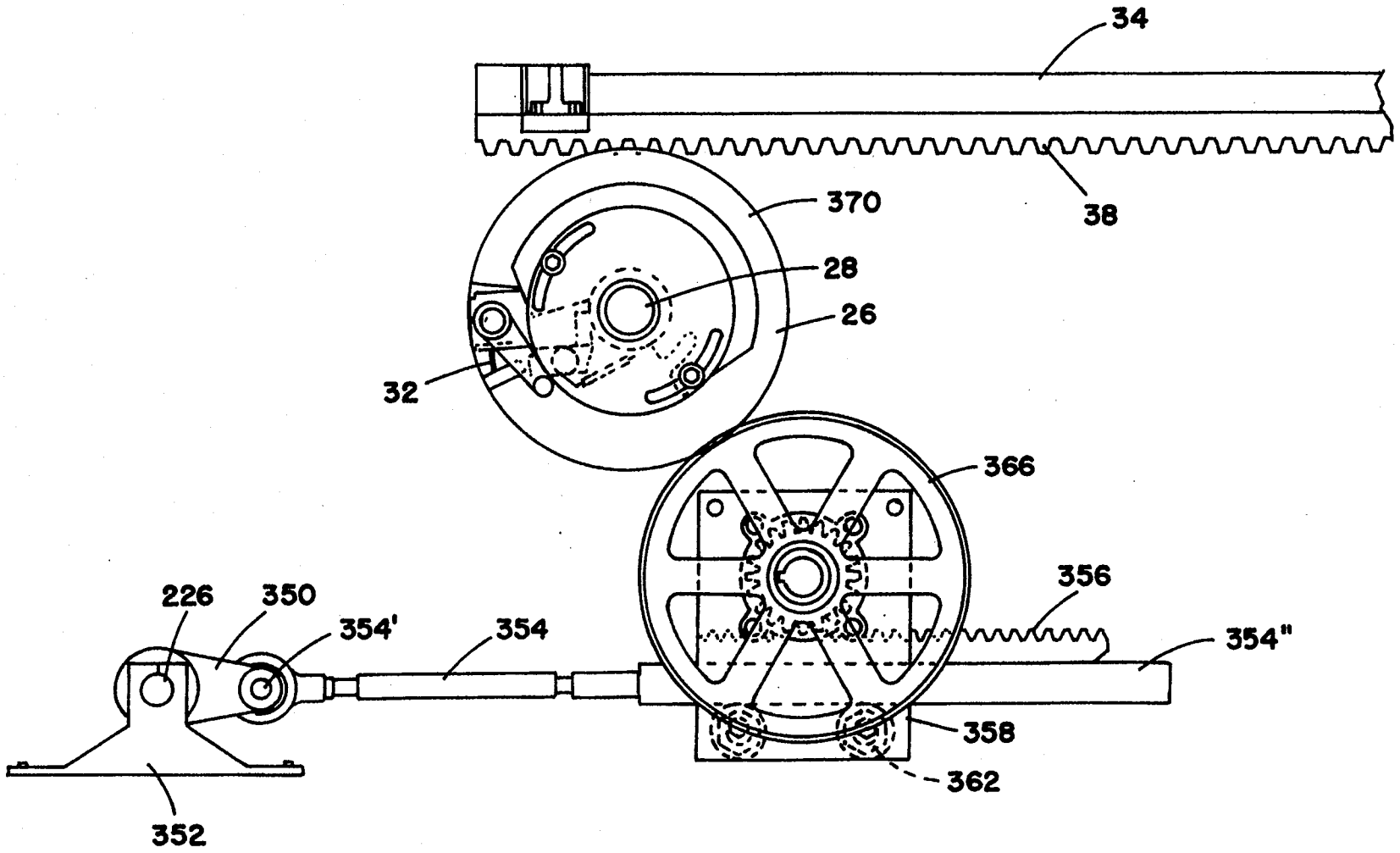
FIG. 20A is an end elevational view of the apparatus in FIG. 20, in a different drive position.
Figure 20B:
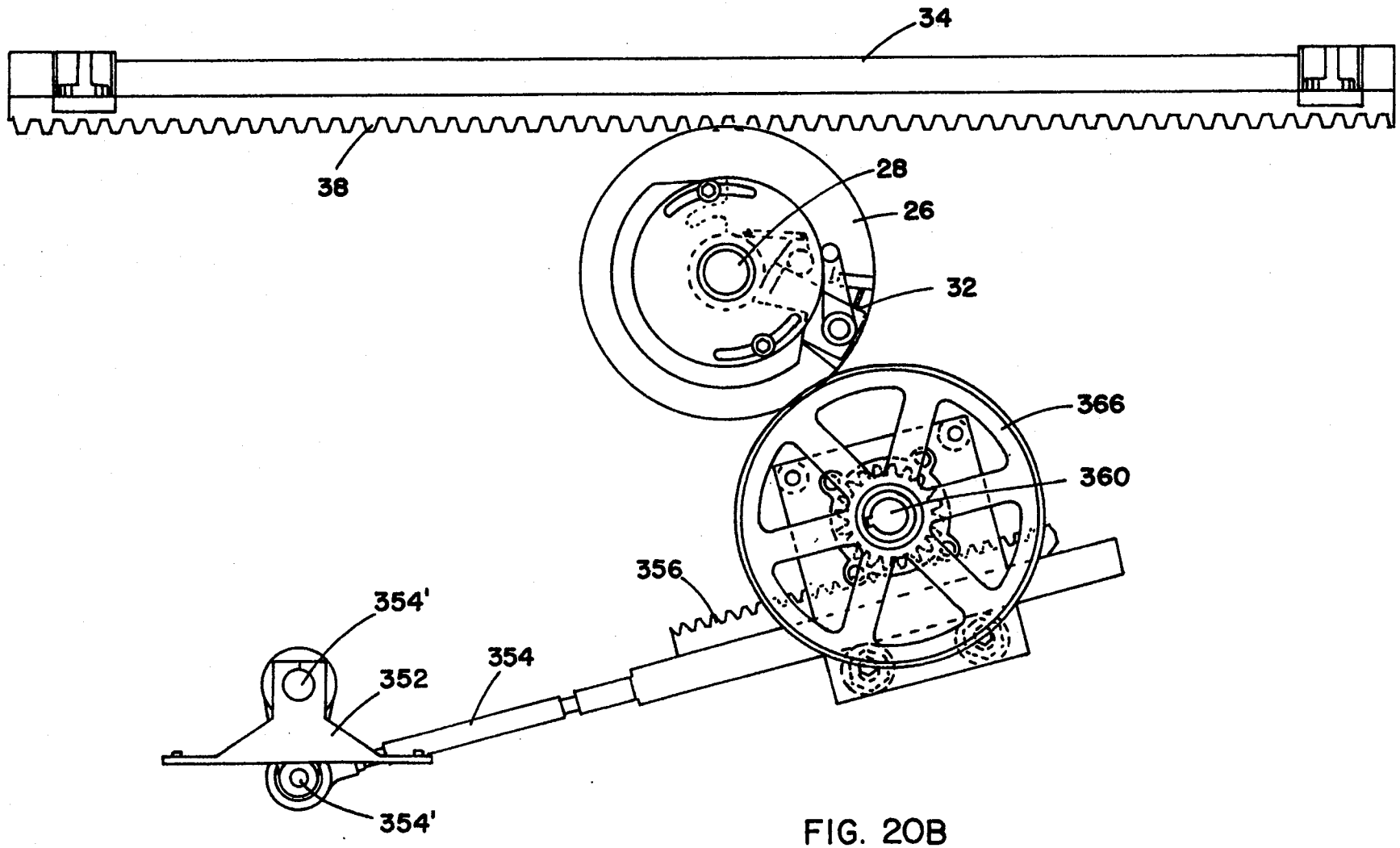
FIG. 20B is an end elevational view of the apparatus in FIGS. 20 and 20A in still a different drive position.

Feeder 14 includes suitable control panels 16, while press 12 includes suitable control panels 18, both mounted on the same side of the assembly for the convenience of the operator. Press subassembly 12 includes a pair of upright, parallel, spaced, side supports 20 in conventional fashion, between which and on which the functional mechanism is mounted. This functional mechanism includes a conventional upwardly forwardly sloped feed board 22 over which a plurality of conventional spaced parallel sheet advancing, recirculatory belts 24 extend to drive individual sheets to be printed up the feed board to the print cylinder 26 (FIGS. 19 and 20). Print cylinder 26 is transversely mounted on a shaft 28 (FIG. 19) extending through cylinder 26 and supported on pillow block bearings 30, to be rotational in reciprocatory fashion in conventional manner, and understood from the more specific explanation hereinafter. Print cylinder 26 has conventional sheet grippers 32 (FIG. 19) in an axial recessed portion of the cylinder periphery (FIG. 20B).

Above cylinder 26 is a stencil screen carriage 34 which receives and mounts a removable stencil screen support frame 36 of conventional type. This carriage and frame combination is reciprocally movable back and forth over print cylinder 26, while the cylinder rotates in a forward direction and then the reverse direction. The frame mounts and supports a removable stencil screen pattern for appropriate printing on sheet stock wrapped around cylinder 26. Typically, the leading sheet edge is held by grippers 32 while the remainder of the sheet is held by suction to the cylinder periphery. Stencil support carriage 34 has a pair of longitudinally oriented elongated gear racks 38 on its underside (FIGS. 19 and 20) on opposite side edges of the carriage, to be driven in a manner to be described hereinafter relative to the novel drive mechanism.

Positioned above the stencil screen is the squeegee subassembly 50 (FIG. 1) which also extends transversely of the press, basically in alignment with, and parallel to, and adjacent the crest of print cylinder 26. This subassembly includes a squeegee element 52, preferably of the inflatable type, mounted on squeegee support bar 54, the ends of which are supported on vertical squeegee lift posts 56 on opposite sides of the press. If squeegee 52 is inflatable, it is supplied by compressed air through a tube 58. The specific movements and functions of the squeegee subassembly, stencil screen and print cylinder will be described in more detail hereinafter. In so functioning, the press is fed sheet stock by the feeder subassembly which will now be described.

Figure 2:
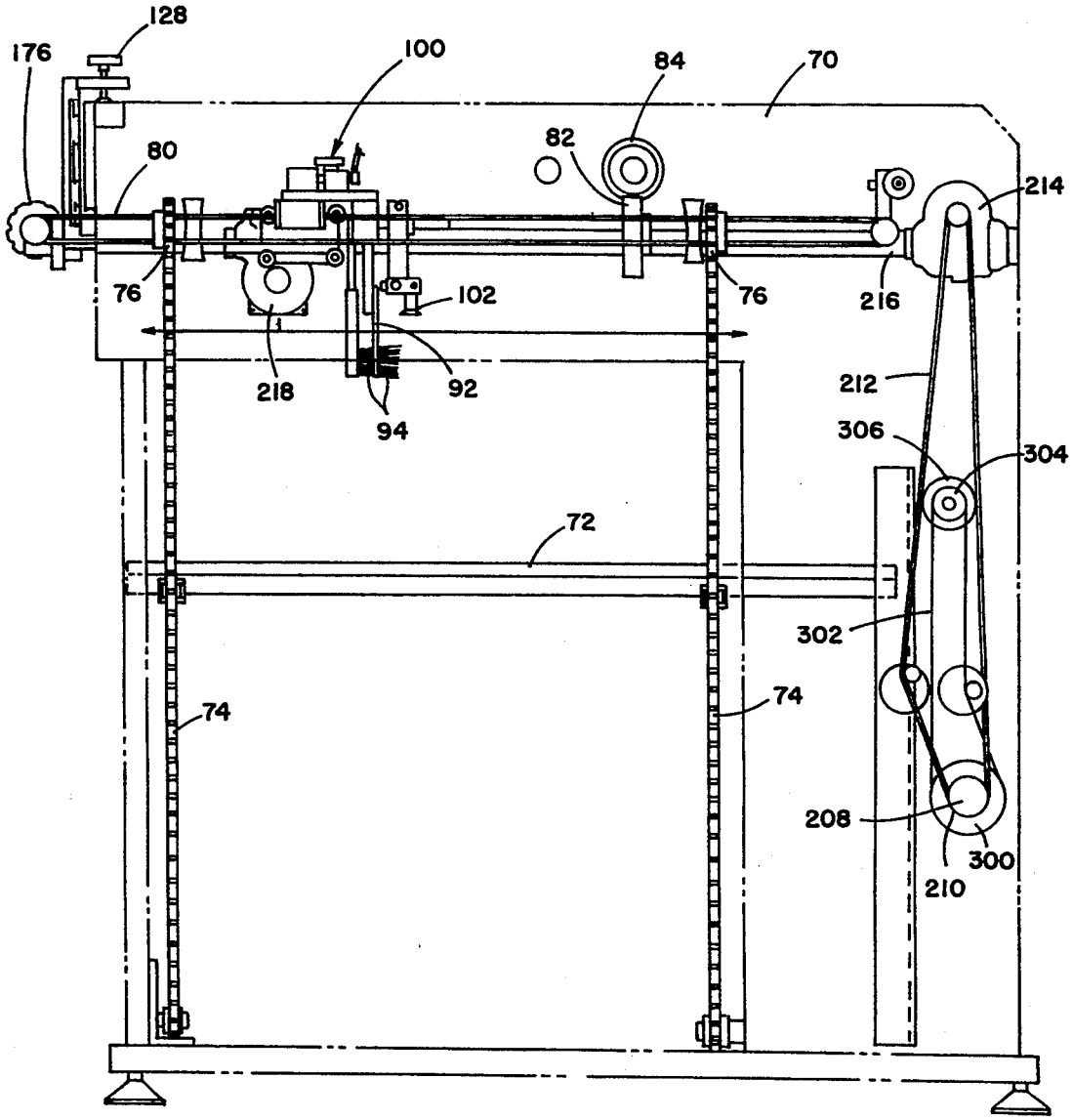
FIG. 2 is a side elevational view of the feeder in FIG. 1.

Feeder subassembly 14 includes a pair of side panel supports 70 which are vertically oriented, parallel to and spaced from each other and in alignment with support panels 20 of the press. Suspended between these two side panel supports is a horizontal stock board support 72 onto which a pile of sheets to be printed is placed. Stock board 72 is horizontal, and is vertically movable, being mounted on stock lift chains 74 on all four corners thereof. It may be solid or a grid of various types. These chains each extend around stock lift drive sprockets 76 at the upper extremities of the chains, and around idler and tightening sprockets 78 at the lower extremities of the chains (FIG. 2). Sprockets 76 are mounted on the ends of a pair of parallel shafts 80 (FIGS. 2 and 5) having spur gears 82 thereon to be driven by worm gears 84. Gear motor 60 (FIGS. 4 and 5) drives reducer/right angle drive 62 which rotates transverse or cross shaft 64 (FIG. 3) on which worm gears 84 are fixed. Spur gears 82 thus drive shafts 80 to rotate sprockets 76 which in turn drive lift chains 74 at the four corners of the stock board.

In this novel apparatus, the sheets may be "stream fed" in overlapping fashion from the rear of the sheets, may be "sheet fed" from the front thereof, or may be "sheet fed" from the rear thereof, as desired. A special movable feeder head subassembly mounted on tracks extending fore to aft of the feeder subassembly accommodates these selectable types of feed. The head can be positioned in an almost unlimited number of positions between the front and rear of the feeder.

Figure 3:
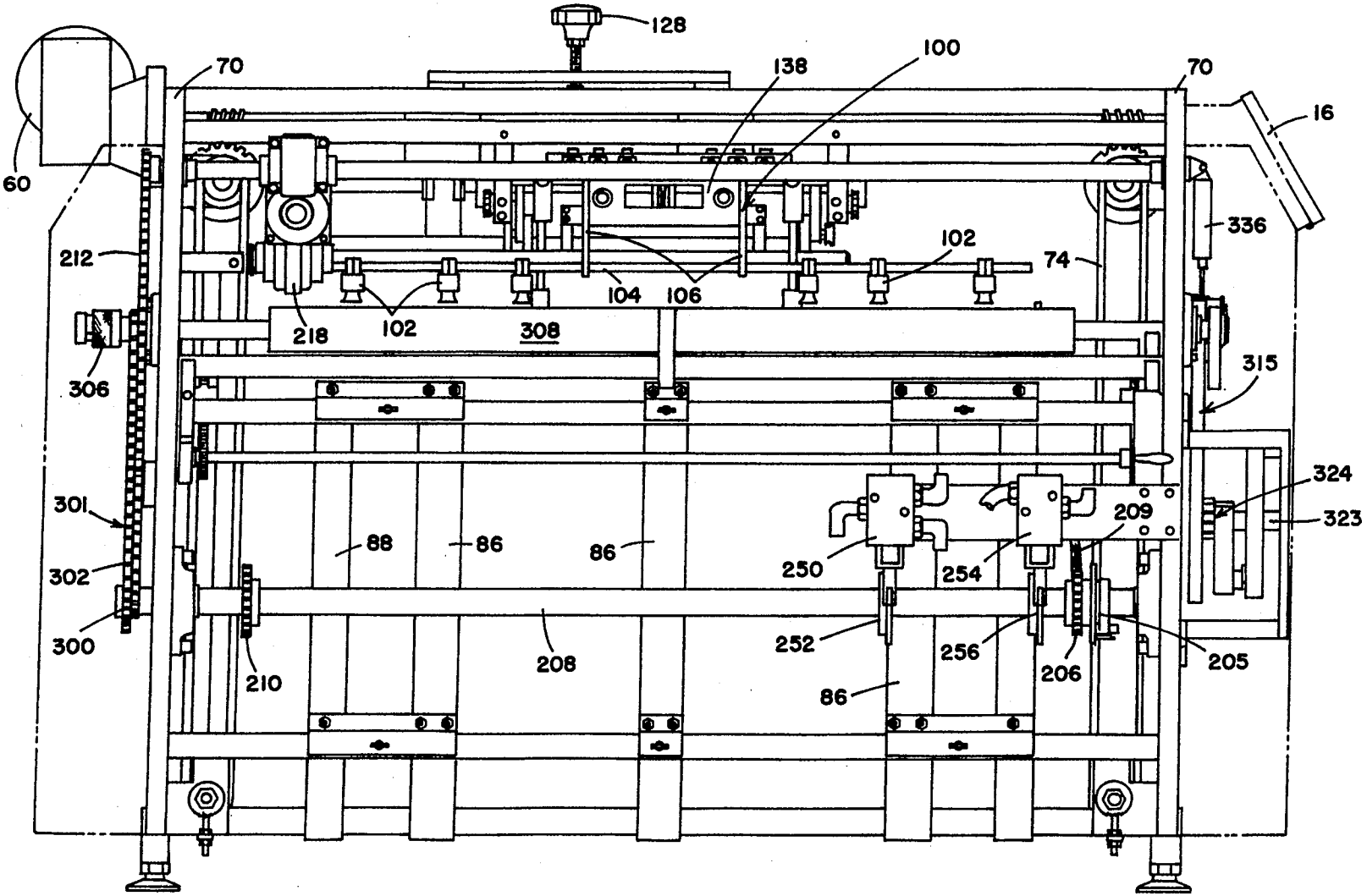
FIG. 3 is an end view of the feeder in FIGS. 1 and 2, viewed from the discharge end.
Figure 4:
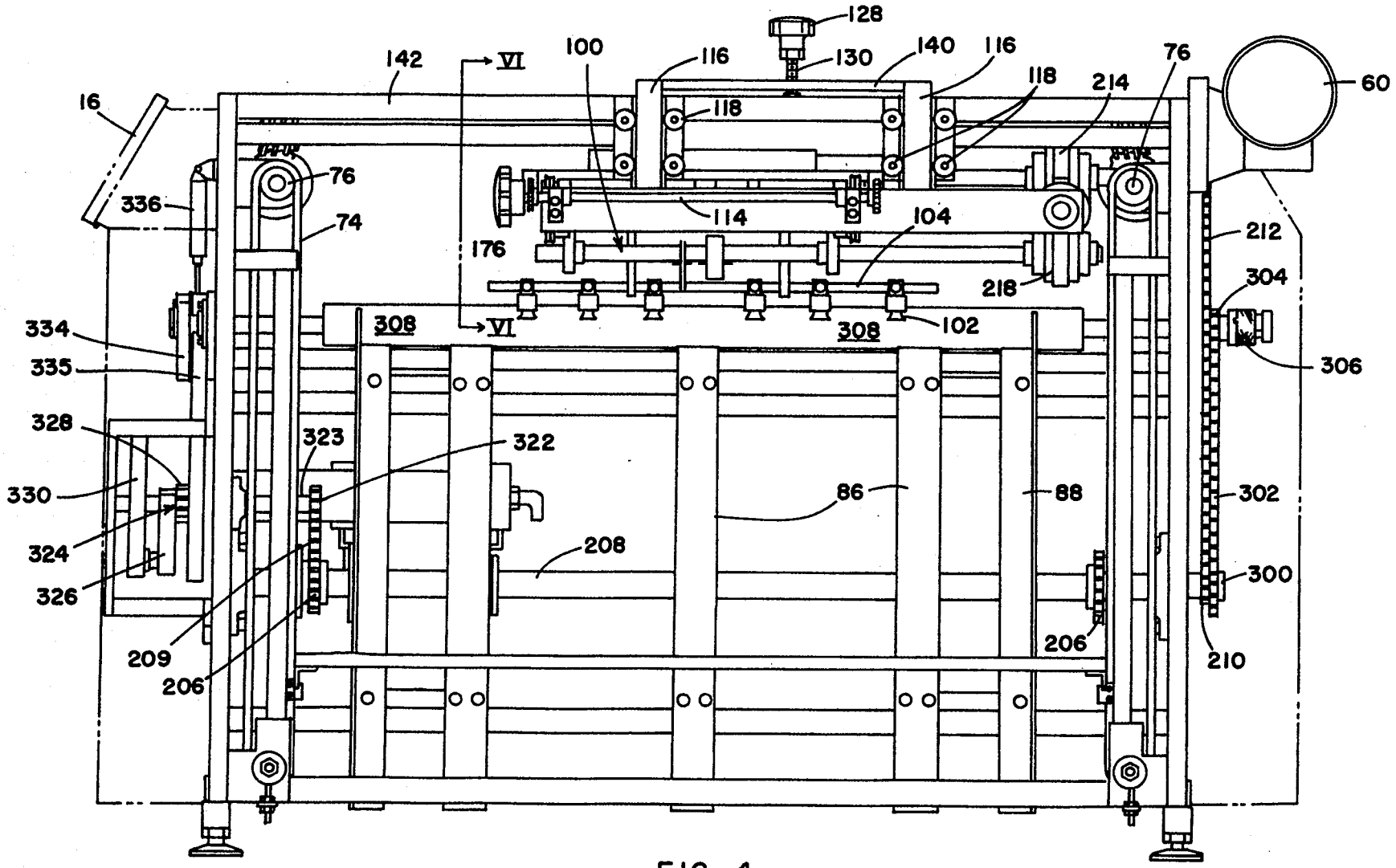
FIG. 4 is an end view of the feeder, looking toward the infeed end.
Figure 6A:
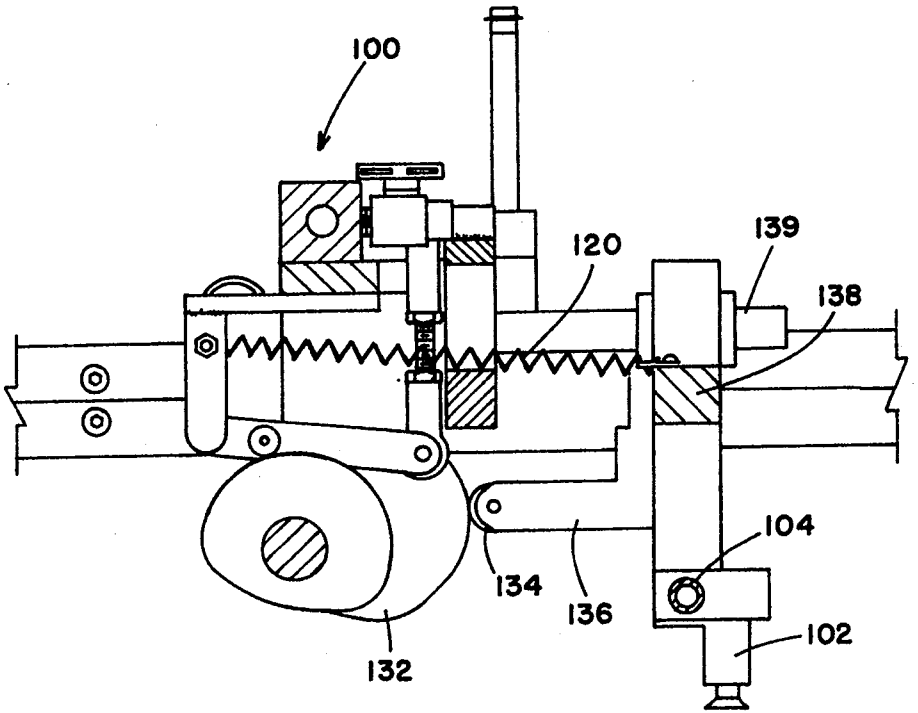
FIG. 6A is a sectional side elevational view comparable to FIG. 6, but in an operational position.
Figure 6:
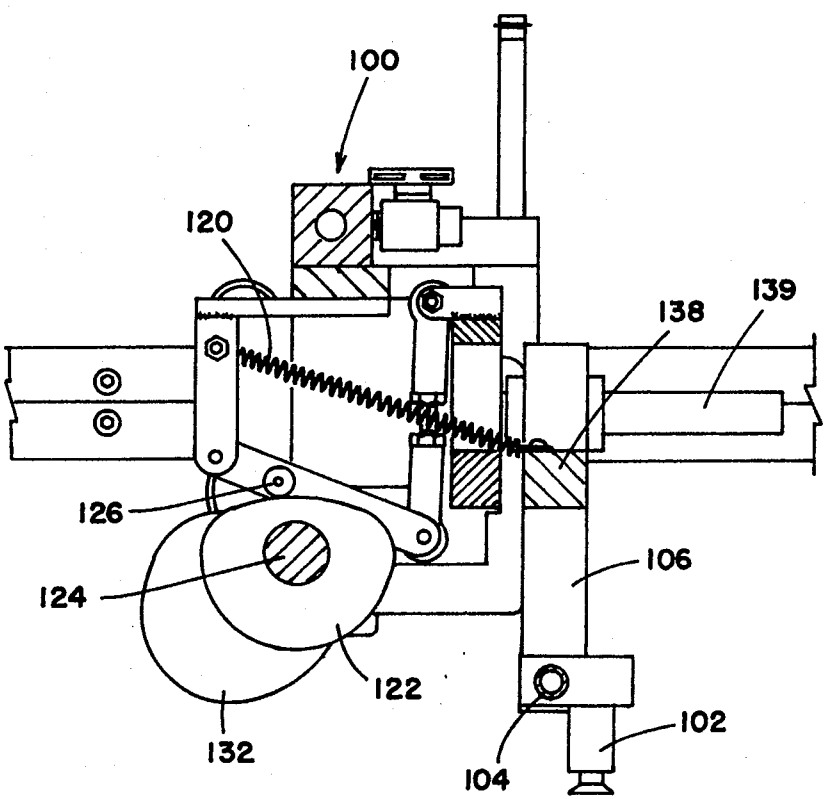
FIG. 6 is a sectional side elevational view of the feeder head subassembly taken on section VI—VI of FIG. 4, and shown in one operational position.
Figure 7:
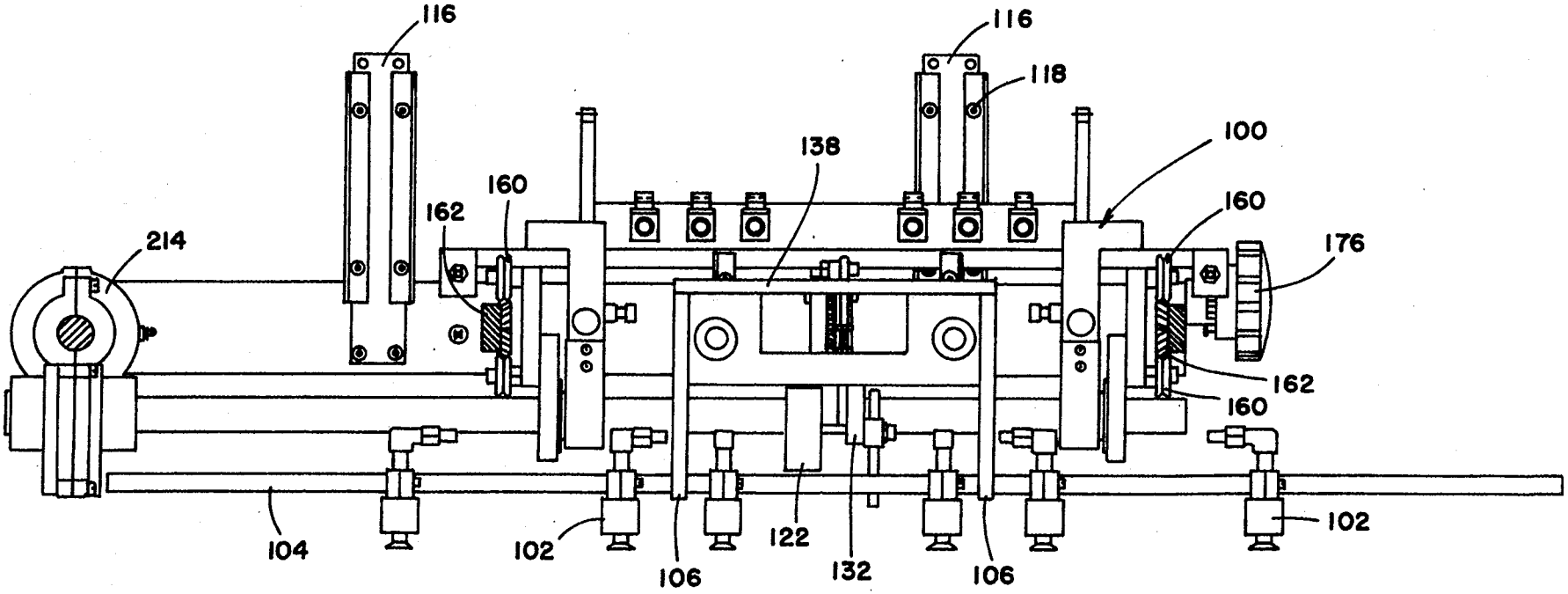
FIG. 7 is a sectional view taken on plane VII—VII of FIG. 5.
Figure 8:
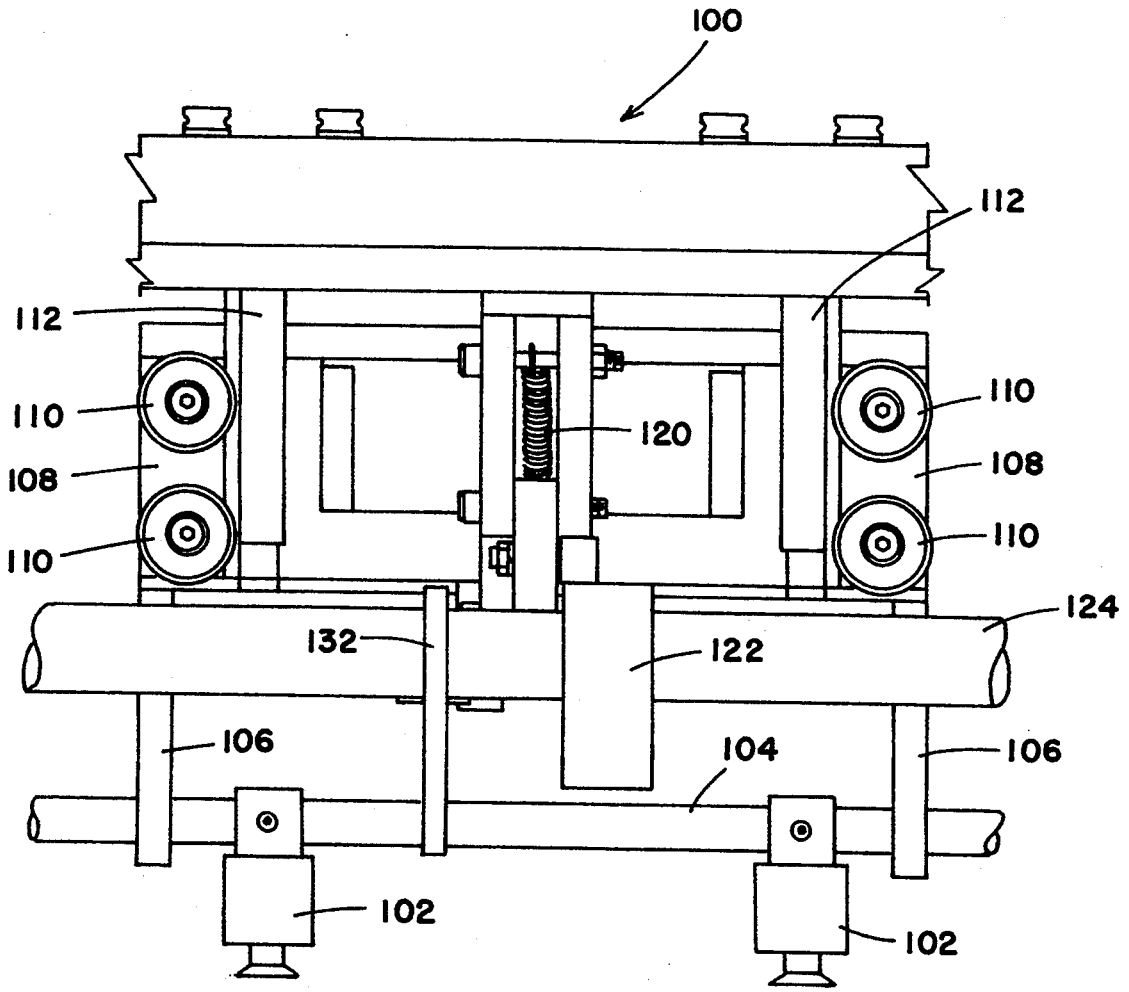
FIG. 8 is a sectional view taken on plane VIII—VIII of FIG. 5.
Figure 15:
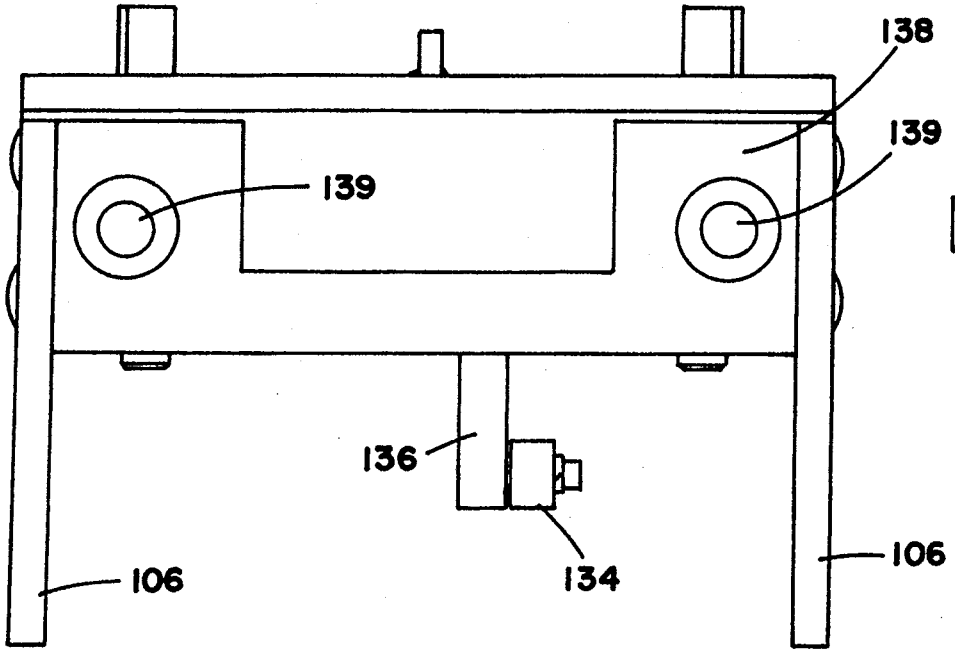
FIG. 15 is a side elevational view of a portion of the feeder head subassembly and track.

The sheets in the stack on the stock board are held vertically aligned by a plurality of vertical, spaced stops 86 (FIGS. 3 and 4), as well as right angle end stock guides 88 (FIG. 4) in conventional fashion. When the sheets are fed from the rear, a rear stock guide 92' (FIG. 2) is provided, as well as a rear sheet separator brush 94'; both mounted on the head subassembly 100 to be cooperable with the stack and the sucker heads 102. Suckers 102 comprise small suction cup units mounted on a transverse support bar 104 in turn suspended from sucker bar arms 106 (FIG. 7). Arms 106 are suspended from a carriage 108 (FIG. 8) which has pairs of vertically spaced rollers 110 ridable on a pair of vertically oriented, spaced V-tracks 112. Tracks 112 are vertically fixed as part of the head subassembly 100. Carriage 108, and therefore suckers 102, are biased upwardly by a rotational cam 122 on rotational cam shaft 124 (FIG. 8). Eccentric cam 122 engages cam follower 126 to cause this vertical action. Gravity returns the carriage and suckers downwardly. Also mounted on cam shaft 124 is another cam 132 for moving the carriage structure and thus the suckers 102 forwardly. Cam 132 moves an engaged cam follower 134 (FIG. 6A) to do this. This cam follower 134 is mounted on a support arm 136 mounted to the slide bracket 138 that supports sucker bar arms 106 (FIGS. 3 and 15). Slide bracket 138 is slidably supported on a pair of slide rods 139 for longitudinal movement thereon as biased by cam 132. Tension coil spring 120 biases the carriage and suckers back rearwardly so as to require follower 134 to follow the peripheral undulating surface of cam 132 as it rotates, the suckers thus being biased forwardly against the tension of the spring by cam 132 and then returning rearwardly under the tension of spring 120. Mounted on head subassembly 100 are shutoff valves 150 (FIG. 5) for the suckers 102.

Figure 5:
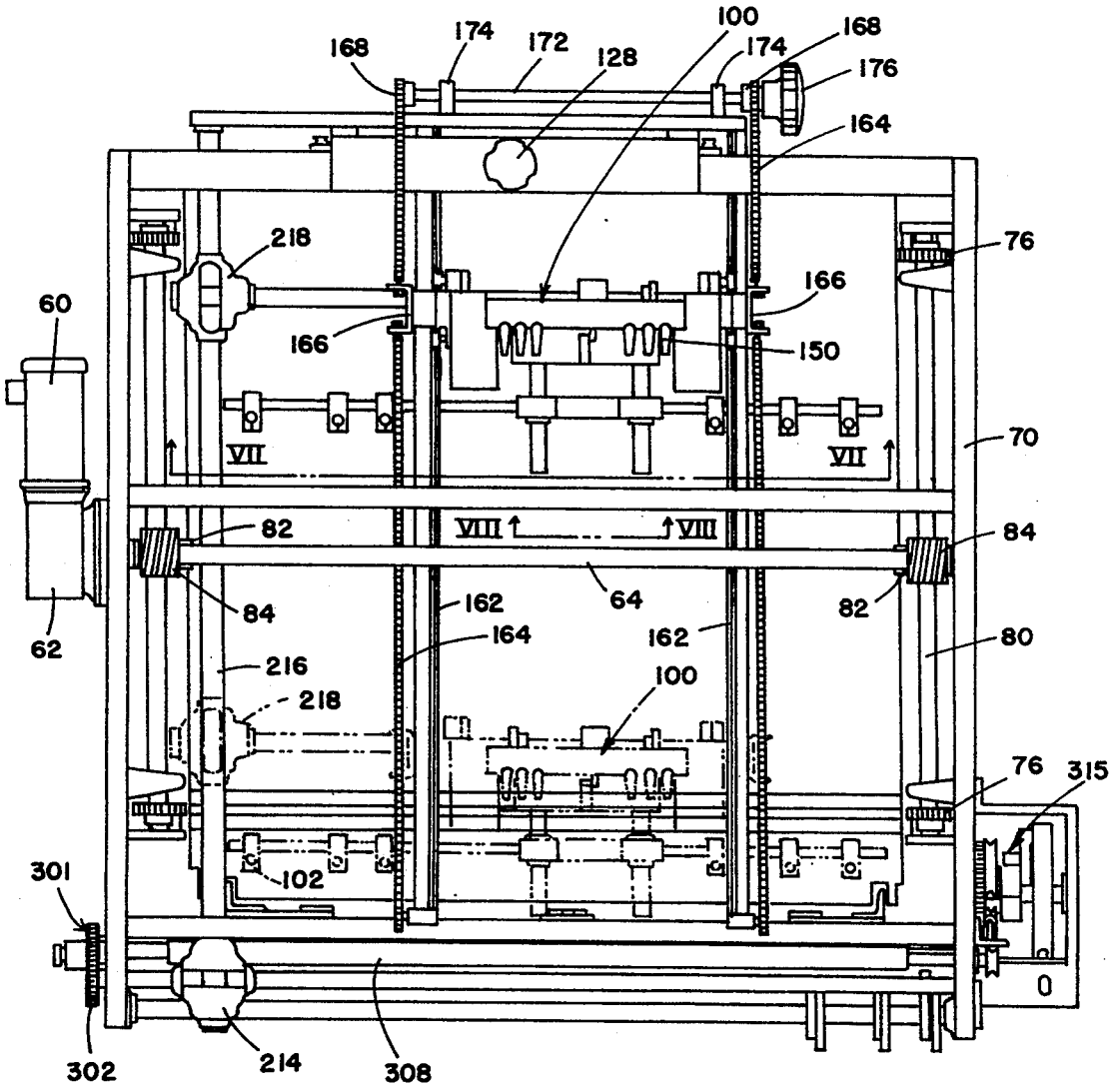
FIG. 5 is a top plan view of the feeder.

As noted previously, a novel feature of the feeder involves the capability of head subassembly 100 to stream feed sheet stock to the printing press, sheet feed sheet stock from the rear, or sheet feed sheet stock from the front, as well as accommodating sheets of varying length from front to rear, with desired positioning of the head. A movable drive connection from the power source (motor) to the sheet feeder head 100 enables driving of the pickup and advancing suckers from any of the varying different positions of the head along the length of the feeder 14. Referring to FIG. 5, a top view of the feeder assembly, a showing is made of the feeder head subassembly 100 in solid lines at the rear of the feeder, and in phantom lines at the front end of the feeder. The feeder head 100 includes a plurality of V-groove rollers 160 (FIG. 7) on opposite ends of the feeder head, placed in pairs above and below each other, to engage the upper and lower edges of a pair of horizontal V-tracks 162 running longitudinally of the feeder. Tracks 162 are parallel to and spaced from each other. These head-transfer V-tracks allow rolling movement of the feeder head subassembly 100 as controlled by the operator through a head position actuator. Specifically, a pair of elongated, flexible, spaced drive members, preferably chains 164 (FIG. 5), have the opposite ends of each chain connected by brackets 166 to feeder head subassembly 100. Those chains extend around sprockets 168 and 170. Sprockets 168 are on shaft 172 mounted on bearings 174 for manual rotation by a head transfer knob 176. By rotation of this knob 176, the operator can move head subassembly 100 to any position between the front and the rear of the feeder, e.g., immediately adjacent the feed board 22 of press subassembly 12 or at the rear of the feeder as depicted in solid lines in FIG. 5. Head subassembly 100 includes a head carriage 114 which is not only movable along tracks 162, but is also vertically adjustable by being supported on vertical suspension pillars 116 (FIG. 4) within roller guides 118. Adjustment is by rotating knob 128 which has a threaded shaft 130 between cross member 140 (FIG. 4) and beam 142. Cross member 140 connects pillars 116.

Vertical and horizontal movement of suckers 102 can be effected whatever position the head subassembly is in along the feeder. Power to the head cam shaft 124 is as follows. Feeder drive jack shaft 208 (FIGS. 2 and 3) rotates sprocket 210 thereon, which drives chain 212 to the fixed-position right angle drive head 214. This drives keyed longitudinal shaft 216 extending lengthwise of the feeder 100. Movable right angle drive head 218 is free to move axially along shaft 216, but is rotationally keyed thereto. It drives transverse head cam shaft 124 to move the cammed suckers 102 vertically and horizontally. Further, there are air nozzles (to be described) which achieve the appropriate sheet lift, front or rear, depending upon where head 100 is placed.

Figure 9:
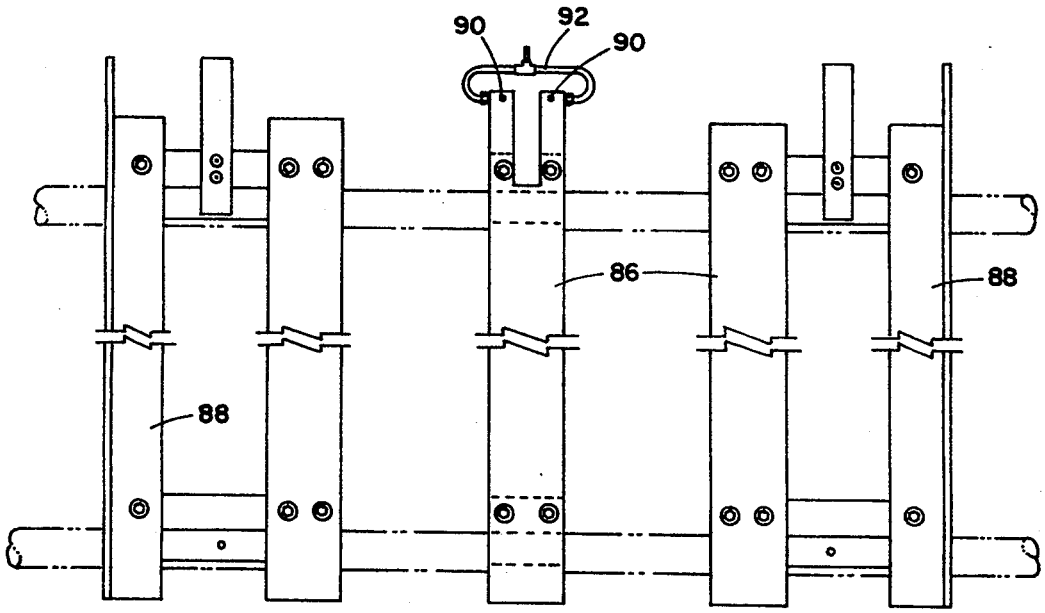
FIG. 9 is an end elevational fragmentary view of the feeder showing the stock guide arrangement.

More specifically, if the sheets are to be fed from the front by lowering of the suckers into engagement with the front portion of the sheet and lifting and advancing the sheet front edge to the recirculatory belts 24 on the feed board 22, a pair of air outlets 90 (FIG. 9) from supply tube 92 at the upper end of the stock guides 86 fluff the front portion of the top sheet off the underlying sheets, for dependable separation.

Figure 10:
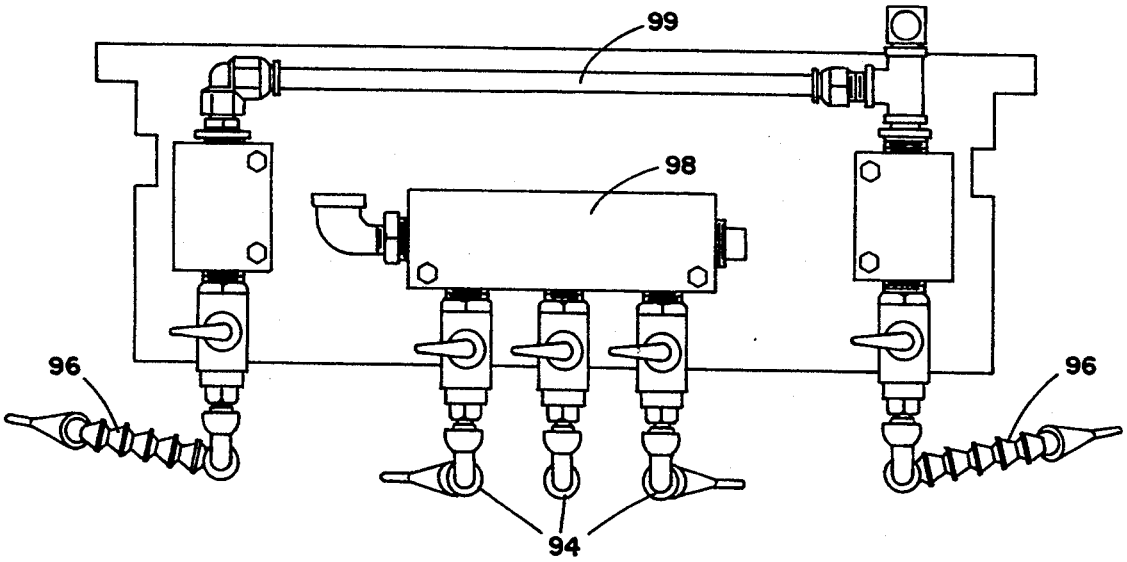
FIG. 10 is an enlarged end elevational view of the rear blast and fluff nozzles of the feeder.
Figure 13:
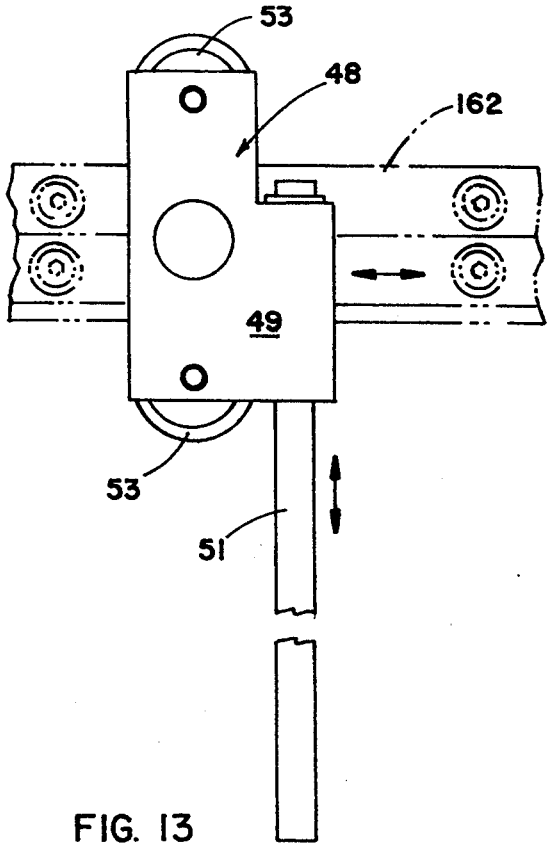
FIG. 13 is a side elevational fragmentary view of the backstop subassembly of the feeder.
Figure 14:
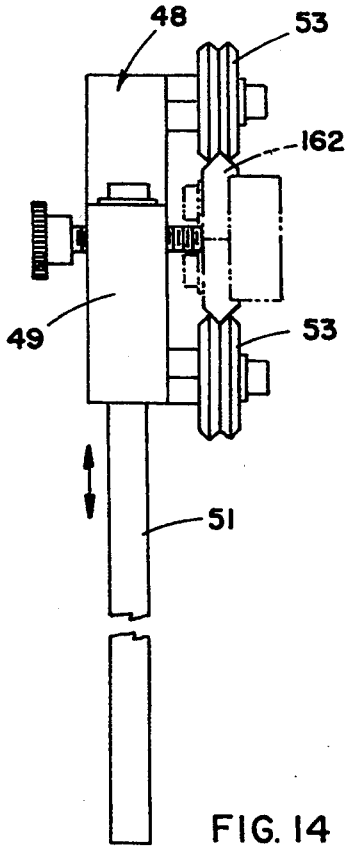
FIG. 14 is an end elevational view of the backstop assembly and track and support bar in FIG. 13.
Figure 11:
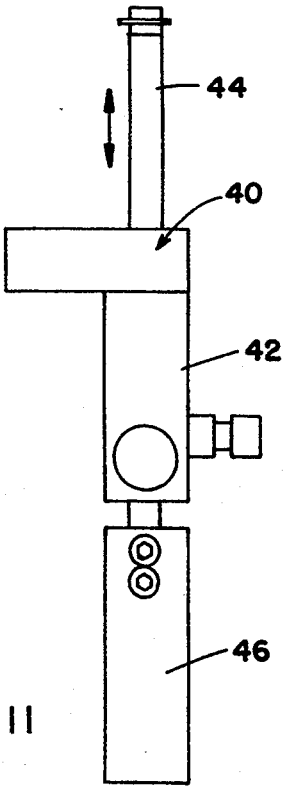
FIG. 11 is an end elevational view of the stock hold-down and guide of the feeder.
Figure 12:
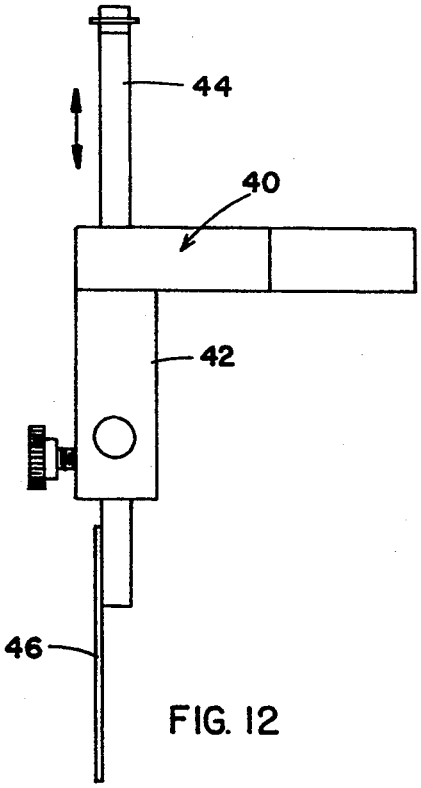
FIG. 12 is a side elevational view of the device in FIG. 11.
Figure 16:
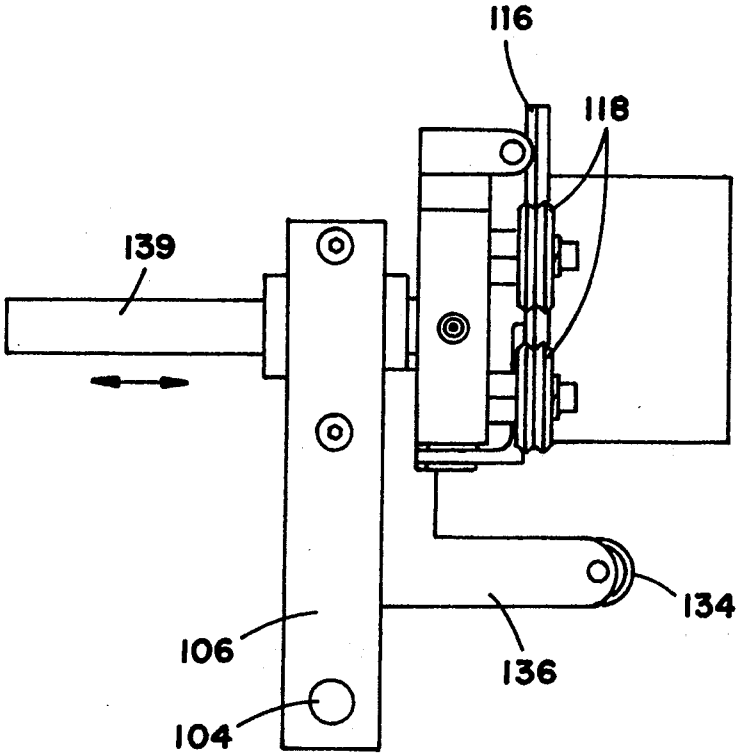
FIG. 16 is an end elevational view of the portion of the feeder head subassembly and V-track in FIG. 15.

If rear feed is to be utilized, the rear air blowing assembly shown in FIG. 10 is employed. More specifically, a trio of rearwardly oriented nozzles 94 is provided in the middle between the two sides of the feeder to effect rear fluff, i.e, to gently lift by pressure of flowing air, the top sheet from the underlying sheets on the stock board, for separate feeding of each sheet by the suckers 102. A pair of rear blast nozzles 96 is oriented forwardly and upwardly so as to lift, by air flow, the fluffed top sheet totally away from the underlying sheets all the way from the rear of the sheet to the front of the sheet, enabling the front edge to be advanced dependably beneath belts 24 on feed table 22. Air is supplied to nozzles 94 through manifold 98. Air is supplied to nozzles 96 through conduit 99. Control of these is through suitable solenoid operated valves. E.g., air blast and fluff solenoid valve 250 (FIG. 3) is controlled by cam 252 on shaft 208. The sucker vacuum is controlled by a valve 254 (FIG. 3) operated by cam 256 on shaft 208.

Referring now to FIGS. 11 and 12, and FIGS. 13 and 14, these set forth rear stop gates mounted on the head assembly 100, to control the sheet stock to be fed. Specifically, the pair of rear stop gauges 40 (FIGS. 11 and 12) serve as back stops for the sheet stock S (FIG. 1) when the feeder is in rear feed condition, either sheet feed or stream feed. Unit 40 has a mounting bracket 42 and a vertically slidable shaft 44 from which depends the stop element 46. The second pair of rear stop gauges 48 (FIGS. 13 and 14) have a body 49 from which a vertical slide rod 51 is suspended. The body 49 is movable along the slide tracks 162 on rollers 53 above and below the tracks. This pair of stop gauges serves as backstops for the sheet stock when feeding from the front of the pile of sheets.

Figure 18:
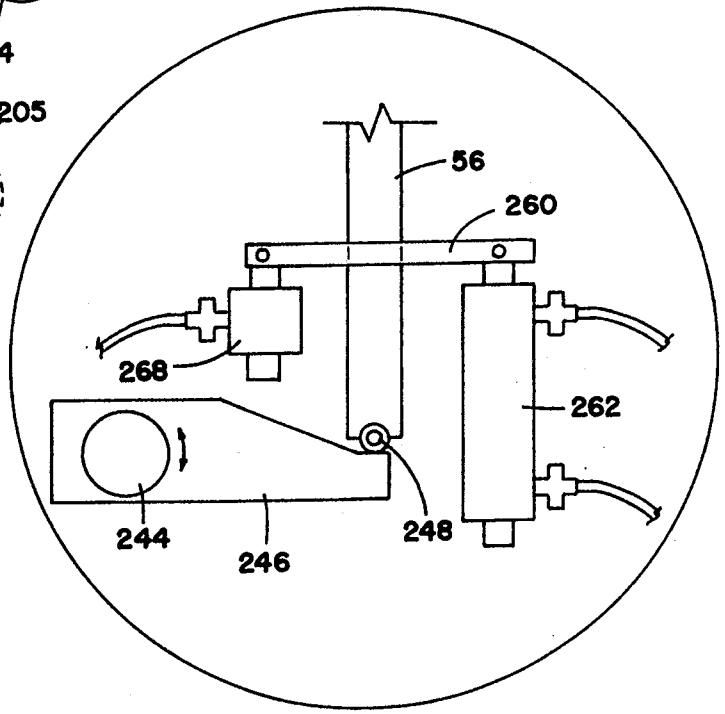
FIG. 18 is a fragmentary side elevational view of the apparatus for putting the squeegee in high lift/hold down and nonprint positions.
Figure 17:
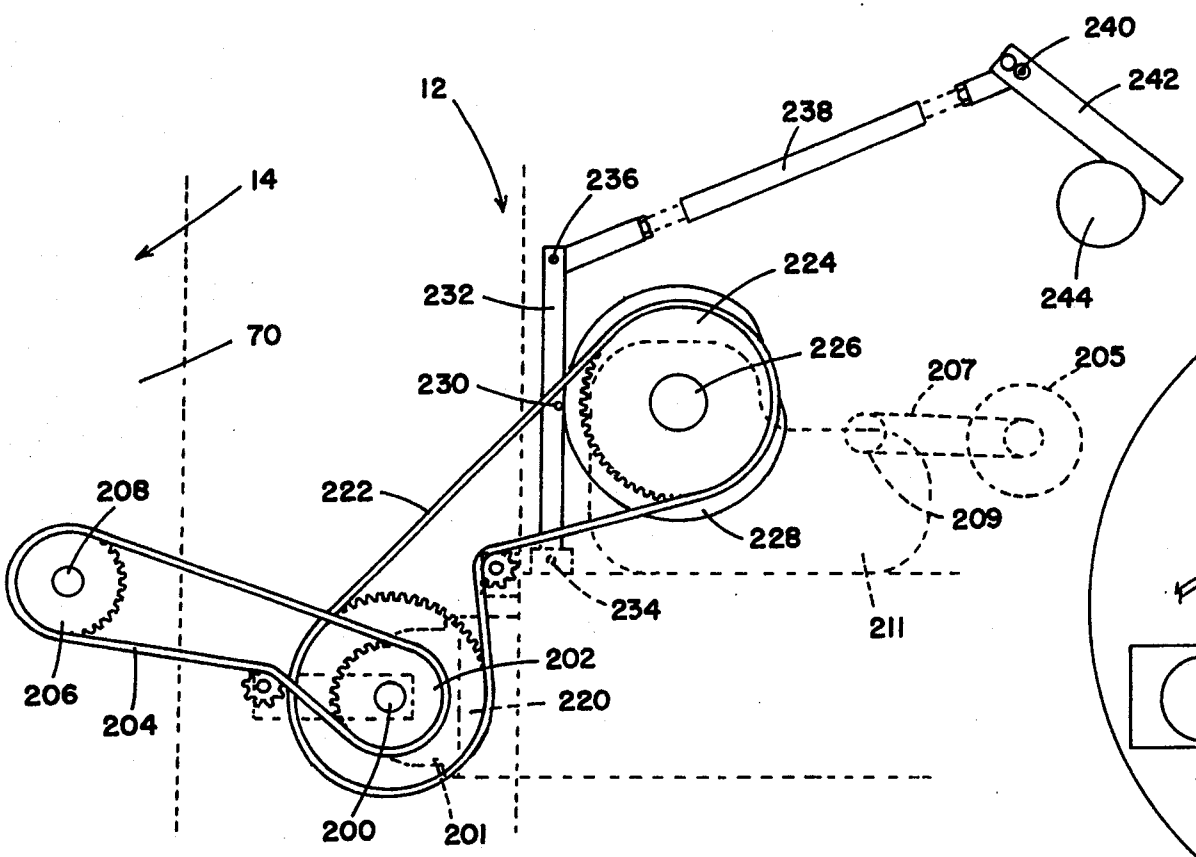
FIG. 17 is a side elevational view of the drive connection from the press drive to the feeder and to the squeegee print stroke and flood stroke.

As mentioned previously, both the feeder subassembly and the press subassembly are driven from the same power unit. Specifically, a power source, normally an electric motor 205, drives a chain or belt 207 to input shaft 209 of gear box reducer 211 having output shaft 226. Sprocket 224 on shaft 22 drives chain 222 to sprocket 220 on front jack shaft 200 (FIG. 17) on which is also mounted a first drive sprocket 202. Sprocket 202 drives chain 204 to a jack shaft sprocket 206 on transverse jack shaft 208 for feeder subassembly 14. Motor 205 also powers press subassembly 12 as through gear box 211. On shaft 226 is a cam 228 which engages cam follower roller 230 mounted on pivot rod 232. The lower ends of rod 232 is pivotally mounted to the framework at 234 while the upper end is pivotally attached at pivotal connection 236 to one end of connecting rod 238. The opposite end of this rod pivotally connects at 240 to link 242 which is fixedly attached to the squeegee lift shaft 244 (FIGS. 17 and 18). Mounted on lift shaft 244 is a pair of squeegee lift cams. These cams are pivoted by linkage 232, 238, 242. Cams 246 engage a pair of cam followers 248 on the lower ends of squeegee lift posts 56. These cams are pivoted to shift the squeegee lift posts and thus the squeegee moves between a) a lowered print stroke wherein the squeegee blade engages the stencil screen as the stencil screen moves between the squeegee and the rotating print cylinder, and b) a slightly raised flood stroke during which the cams lift the squeegee slightly off the print cylinder and screen a controlled fraction of an inch so that the blade serves on the return stroke to coat the screen in another layer of ink in a conventional fashion.

Also connected with the squeegee lift posts are two pairs of special fluid, e.g., air, cylinders depicted in FIG. 18. These pairs of cylinders are attached to mounting plates 260 engaging the two squeegee lift posts 56 at opposite ends of the squeegee. Cylinders 262 of the first pair constitute long air cylinders which are double acting. In the extension condition, the piston rods extending from cylinders 262 serve to "high lift" the posts and high lift the squeegee out of the stencil screen support frame and carriage, e.g., for removal or insertion of a stencil. The contracted position of cylinders 262 pulls the squeegee into a holddown condition for tight engagement of the flexible squeegee with the stencil screen during the print stroke.

Cylinders 268 of the second pair are shorter, one-way cylinders. Specifically, cylinders 268, when extended, lift the squeegee posts, and thus the squeegee, only a small amount above the stencil screen, higher than the flood position but still within the stencil screen frame. This enables the operator of the press to simulate a print stroke but not actually print, e.g., for test purposes. This is particularly advantageous since the operator may wish to test the stroke length or other feature of the rapidly reciprocating mechanism prior to actually printing, but is immediately able to deactuate this cylinder at the end of the simulated print stroke, causing the squeegee to immediately drop to the print condition and be held down by cylinder 262 to accomplish a complete print stroke on the very next cycle. Cylinders 262 are inactive when cylinders 268 are active, and vice versa. If such a nonprint test is attempted using the high lift cylinders, the squeegee would be part way through the subsequent print stroke before it engages the stencil screen, thereby producing a faulty product.

Figure 21:
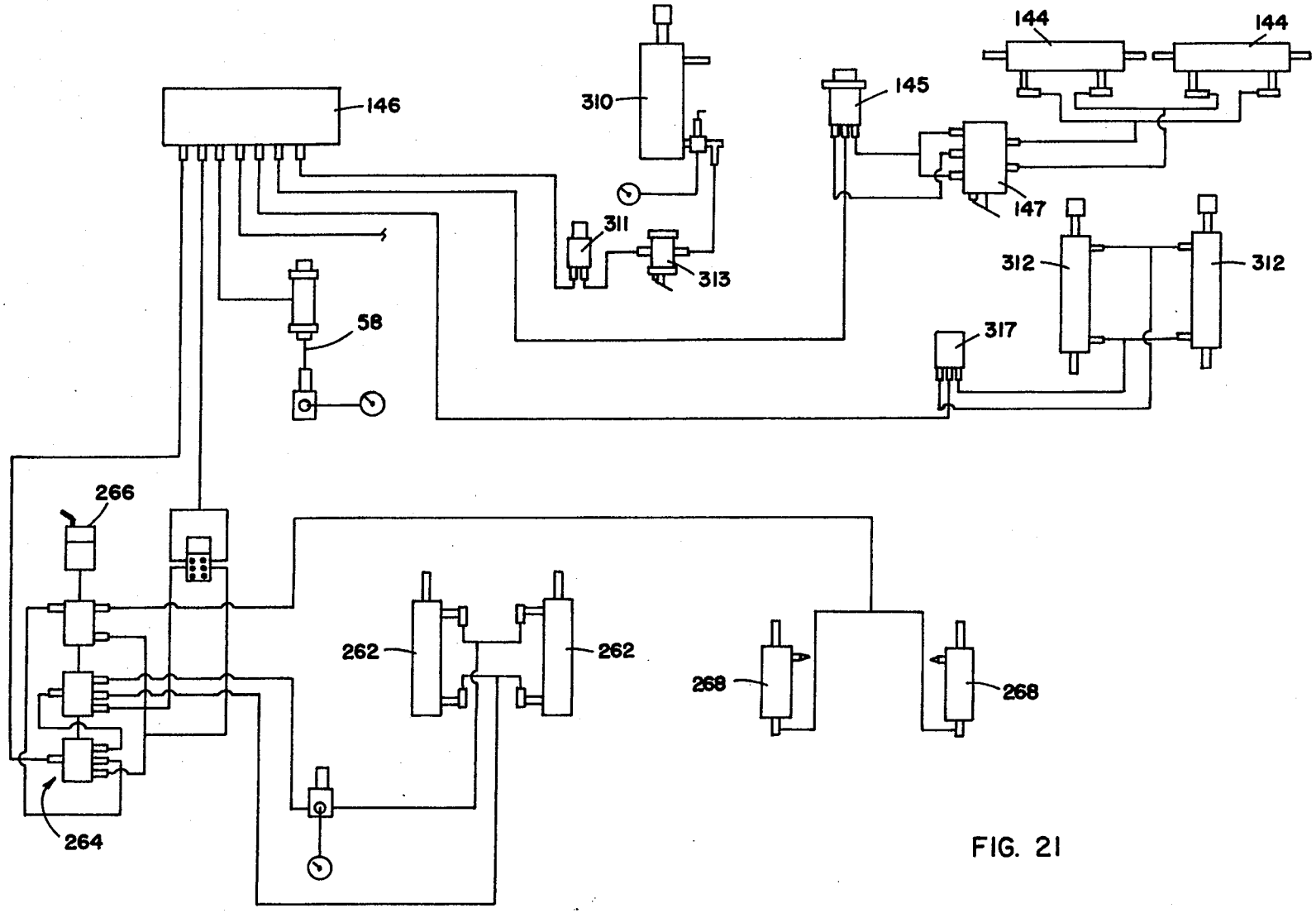
FIG. 21 is a schematic diagram of a pneumatic system for the apparatus.

The press may include suitable side-shifting sheet alignment cylinders 144 (FIG. 21) shown in the schematic of the pneumatic circuit. Cylinders 144 receive air via air selector switch 145 and cam type air switch 147. The various pneumatically responsive components are supplied from a manifold 146. This serves high lift cylinders 262 and nonprint cylinders 268 through a three-position valve 264 and switch 266 therefor. It also serves feed board lift cylinder 310 through air switch 311 and cam type air switch 313 (FIG. 21)and serves delivery table lowering cylinders 312 via air selector switch 317.

Referring again to the main drive mechanism (FIG. 17) and its driving of jack shaft 208 for the feeder, this feeder is actually capable of stream feed or sheet feed through this same jack shaft 208. At one end of shaft 208 is a constant speed drive mechanism 301 for stream feeding. At the other end of shaft 208 is a one direction drive clutch which drives chain 209 (FIG. 3) which drives a sprocket 322 (FIG. 4) on a stub shaft 323 to effect an alternate, variable speed, drive mechanism 315 for sheet feeding. Referring now to FIGS. 2, 3, 4 and 5, at the one end of shaft 208 is operating constant speed drive mechanism 301 for stream feed, i.e., sheets in overlapping relationship. This comprises a sprocket 300 on shaft 208, driving a chain 302 to a second sprocket 304 operating through a manually releasable clutch 306 (FIG. 4), to drive roller 308 around which the plurality of spaced, parallel sheet advancing belts 24 pass. Roller 308 drives belts 24 to feed sheets up feed board 22. By manually rotating releasable clutch 306, the drive train to this roller 308 can be connected or disconnected. On the opposite end of drive shaft 208 is the variable speed drive 315. This variable speed drive is actuated from shaft 208 through one way clutch 205 and sprocket 206 on shaft 208, which sprocket drives chain 209 (FIGS. 3 and 4) to sprocket 322 on stub shaft 323. Shaft 323 drives a variable speed spur gear/ring gear and crank arrangement 324. Crank 326 drives spur gear 328 inside ring gear 330, which is an eccentric inside cam, to cause the drive to slow down at certain arcuate segments of the crank motion. This in turn constantly drives timing belt 335 to drive roller 308 from its opposite end. A belt tightener operated by a pneumatic cylinder 336 shifts belt 334 to serve as a clutch, i.e., drive release.

The above two drives to the two ends of roller 308 operate alternatively, not simultaneously. Thus, when belt 334 of the variable speed drive is to be actuated for sheet feeding, cylinder 336 tightens belt 334 while clutch 306 on the opposite end of roller 308 is disengaged. Operation of V-belt 334 causes timing belt 335 to drive shaft 308 at the variable speed for the sheet feed action. Alternatively, when chain 302 is to drive roller 308 for constant speed stream feed, clutch 306 is engaged while clutch cylinder 336 causes slack in drive belt 334 to release it. The reason for variable speed drive on roller 308 during sheet feed is because of the fact that individually fed sheets tend to arrive at the print cylinder too rapidly if not slowed down during the last portion of their transfer over the feed table. A sheet arriving too rapidly at the grippers of the print cylinder will bounce and be out of registry when gripped. This is a well known factor. The slowdown effect occurs no matter where the feeder head is located, i.e., near the front or the rear. Other types of slowdown mechanisms have been utilized heretofore on feed mechanisms.

The main drive from gear box 211 also rotationally operates the print cylinder in oscillatory fashion and the stencil screen carriage in synchronized, linearly reciprocating oscillations. This is done with a novel drive between the main drive and the cylinder and gear rack of the support frame as depicted in FIGS. 19, 20, 20A and 20B. This novel drive has been found extremely effective in preventing jam up of the press if any foreign matter gets into the main gear rack drive, and also simplifying overhaul or repair of the drive mechanism. Specifically, a rotating crank 350 mounted on a bearing mount 352 and driven by shaft 226 is pivotally connected to one end 354' of a drive rod 354, the other end of the drive rod being unconnected so that the drive rod can have a free rocking action. On the top of the other end portion of the drive rod is a driving gear rack 356. The driving rack and its underlying support 354" cooperate with a rocking carriage 358 mounted on shaft 360. Carriage 358 is preferably made of a pair of parallel spaced plates which mount a pair of spaced bearings 362 on the lower portion thereof, engaging the undersurface of support 354". These are preferably eccentrically mounted bearings on axles 363 (FIG. 20) to allow vertical adjustment by loosening the axles and eccentric rotation of the axles and bearings thereof, for easily and quickly vertically adjusting the height of support 354" and drive rack 356, for optimum engagement of drive gear rack 356 with a pinion gear 364. The pinion gear is also mounted on shaft 360 so that reciprocation of rack 356 oscillates shaft 360. Affixed to shaft 360 is a pair of spur gears 366, the outer teeth of which engage the correspondingly configured teeth of a pair of drive gears 370 at opposite ends of print cylinder 26. Shaft 360 is mounted on a trio of pillow block bearings 372 (FIG. 19). Upper gears 370 not only rotate shaft 28 on which print cylinder 26 is mounted, but also engage the gear racks 38 on the underside of the opposite side edges of stencil screen support carriage 34. As crank 350 is rotated, therefore, the drive mechanism will move through a series of motions, three of which are illustrated in FIGS. 20, 20A and 20B, causing the drive rod 354 and gear rack 356 to be extended and retracted while simultaneously rocking it through a substantial acute angle. This rocking motion causes carriage 358 to rock about its shaft 360, while driving rack 356 simultaneously rotates pinion gear 364 which rotates shaft 360 and spur gears 366, to drive print cylinder gears 370 and stencil frame racks 38, to thereby oscillate the print cylinder 26 through a predetermined angle while simultaneously driving the stencil thereover beneath the longitudinally fixed squeegee, so that an advancing sheet on the cylinder will be printed. At the end of the print stroke, the sheet grippers 32 and the vacuum on the cylinder release to drop the sheet from the cylinder onto the delivery table.

The feed board or feed table 22 is pivotally mounted on its transverse edge away from print cylinder 26. The end close to the print cylinder is shiftable upwardly by a vertical pneumatic cylinder 310 (FIG. 21) beneath it so that feed board 22 can be lifted away from cylinder 26 for access as for cleaning and/or repair purposes. Prior presses required manual lifting of the feed table.

The delivery table at the discharge end of the printer is also pivotally mounted on its transverse edge away from the print cylinder. The end adjacent the print cylinder is attached to a pair of underlying pneumatic cylinders 312 (FIG. 21) so that the delivery table and the attached stripper plate at the cylinder can be lowered away from the cylinder as for cleaning, etc. Prior presses had a gear driven lowering action.

Several other advantages and features of the novel apparatus may readily occur to those in this field of endeavor upon studying this disclosure of the preferred apparatus set forth as exemplary of the invention. Also, some minor modifications could be made in the illustrative embodiments depicted, without departing from the concepts presented. As one example, the tracks on which the sheet feeder head is movable could be a unitary structure. As another example, the first and second clutches for the variable speed drive and the constant feed drive could be combined into one mechanism. Hence, the invention is intended to be limited only by the claims and the reasonably equivalent structures to those set forth herein.

The embodiments of the invention in which an exclusive property or privilege is claimed are defined as follows:

1. A stencil screen printing press comprising:

a reciprocally movable stencil screen carriage for mounting a stencil screen frame and stencil;

a sheet retaining print cylinder beneath and cooperative with said carriage. being rotationally reciprocable simultaneously with carriage reciprocation;

a squeegee above and cooperative with said carriage and said print cylinder;

a sheet feeder assembly for advancing sheets to said print cylinder to be printed;

said sheet feeder assembly having first and second alternate drive mechanisms;

said first drive mechanism having a variable speed drive for sheet feeding individual sheets separated from following sheets and slowing feed of each sheet as the sheet approaches said print cylinder;

said second drive mechanism having a constant speed drive for stream feeding overlapping sheets to said printing cylinder;

said sheet feeder assembly comprising a transverse drive shaft having first and second ends, said first drive mechanism being connected to said first end thereof and said second drive mechanism being connected to said second end thereof;

a first clutch for engaging or disengaging said first drive mechanism; and a second clutch for engaging or disengaging said second drive mechanism.

2. A stencil screen printing press comprising:

a rotational stock gripping and advancing cylinder having a pair of ends;

a stencil screen carriage and stencil screen frame on said carriage, reciprocable back and forth over said cylinder;

a squeegee mount adjacent said cylinder ends, for mounting a squeegee above said cylinder and across said stencil screen carriage and frame;

cams for vertically moving said squeegee between a lowermost print position and a slightly raised flood position, both within said stencil screen frame;

high lifts engaging said squeegee mount and actuable to high lift said squeegee up out of said stencil screen frame and allow removal of said stencil screen frame from said press; and nonprint lifts engaging said squeegee mount and actuable to lift said squeegee mount away from said cams and said squeegee out of print position, but still within said stencil screen frame, to thereby allow said stencil screen frame to cycle without printing while allowing observable stencil screen frame movement testing.

3. The stencil screen printing press in claim 2 wherein said high lifts comprise a first pair of double acting fluid cylinders which also serve as hold down cylinders during printing, and said nonprint lifts comprise a second pair of fluid cylinders independent of said first pair of fluid cylinders, and having a lesser lift action than said first pair of fluid cylinders.

4. A stencil screen printing press having a rotationally reciprocable print cylinder with gears on the ends thereof, a linearly reciprocable stencil screen carriage above said print cylinder for being reciprocated over said print cylinder, a squeegee subassembly above said stencil screen carriage and print cylinder, and a reciprocable rocker drive for reciprocating said stencil screen carriage and said print cylinders comprising:

a drive shaft parallel to said print cylinder;

said stencil screen carriage being connected to said drive shaft to be reciprocated thereby;

a pinion gear on said drive shaft;

an elongated drive rod and gear rack having first and second ends, and a rack of teeth along said second end and engaged with said pinion gear;

a pivotal bearing support supporting said gear rack in engagement with said pinion gear; and a drive crank rotationally connected at said first end of said drive rod and gear rack, whereby rotation of said drive crank will reciprocate said drive rod and gear rack while rocking it about said pivotal bearing support, to thereby rotationally reciprocate said pinion gear to rotatably drive said drive shaft in opposite directions causing rotational reciprocation of said cylinder and linear reciprocation of said carriage.

5. The stencil screen printing press in claim 4 wherein said bearing support comprises a pair of spaced bearings vertically offset from said pinion gear, and said pivotal beating support is rockably mounted on said drive shaft.

6. The stencil screen printing press in claim 5 wherein said spaced bearings are rotationally eccentrically mounted on horizontal axles beneath said drive rod and gear rack such that rotation of said axles and bearings will eccentrically vertically adjust said bearings.

7. A stencil screen printing press comprising:

a reciprocally movable stencil screen carriage for mounting a stencil screen frame and stencil;

a sheet retaining print cylinder beneath and cooperative with said carriage being rotationally reciprocable simultaneously with carriage reciprocation;

a squeegee above and cooperative with said carriage and said print cylinder;

a sheet feeder assembly for advancing sheets to said print cylinder to be printed;

said sheet feeder assembly comprising:

a stock support for supporting a stack of sheets to be fed;

a feed table having sheet advancing belts for advancing sheet stock to said print cylinder;

a sheet feeder head having driven, reciprocable, sheet pickup advancers adjacent said feed table and said stock support, positioned to pick up and advance individual sheets from said stock support to said sheet advancing belts of said feed table;

a power source;

said stock support having a front end adjacent said feed table, and a rear end displaced from said feed table;

tracks above said stock support, longitudinally arranged between said front end and said rear end of said stock support;

said sheet feeder head having said sheet pickup advancers projecting toward said stock support front end;

said sheet feeder head being movably mounted on said tracks between said front end with said sheet pickup advancers at said front end for sheet feed by said sheet pickup advancers, and at said rear end for either sheet feed or stream feed by said sheet pickup advancers;

a sheet feeder head position actuator operably connected to said sheet feeder head for moving said sheet feeder head to different positions at said front end for front feed of sheets, and at said rear end for rear feed of sheets; and a movable drive connection from said power source to said sheet feeder head for enabling drive of said sheet pickup advancers in said different front end and rear end positions.

8. The printing press feeder in claim 7 wherein said movable drive connection comprises an elongated, keyed, rotational shaft extending parallel to said tracks, and a right angle drive movable along and keyed to said keyed shaft, and connected to said pickup advancers, for driving said pickup advancers from said different positions.

9. The printing press feeder in claim 7 wherein said tracks are V-tracks and said sheet feeder head has rollers engaging said V-tracks.

10. The printing press feeder in claim 7 including alternate drive connection mechanisms to said sheet advancing belts for sheet feed or stream feed operation thereof.

11. The printing press feeder in claim 7 wherein said sheet feeder head has a plurality of spaced suction units, said units being vertically up and down shiftable and forwardly-rearwardly shiftable;

a vertical shifter device for said suction units, and a forward-rearward shifter device for said suction units, causing said suction units to move in a cycle to be shifted down to pick up a sheet, be shifted up and forwardly to advance the sheet, and be shifted rearwardly and down to pick up the next sheet, and said power source being connected to both said shifter devices through said movable drive connection.

12. The printing press feeder in claim 11 wherein said vertical shifter device is a first cam and said forward-rearward shifter device is a second cam.

13. A stencil screen printing press comprising:

a reciprocally movable stencil screen carriage for mounting a stencil screen frame and stencil;

a sheet retaining print cylinder beneath and cooperative with said carriage being rotationally reciprocable simultaneously with carriage reciprocation;

a squeegee above and cooperative with said carriage and said print cylinder;

a sheet feeder assembly for advancing sheets to said print cylinder to be printed;

said sheet feeder assembly comprising:

a stock board for supporting a stack of sheets to be fed;

a feed table having sheet advancing belts for advancing sheet stock to a printing press;

a sheet feeder head having driven, reciprocable, sheet pickup advancers adjacent said feed table and said stock board, positioned to pick up and advance individual sheets from said stock board to said sheet advancing belts of said feed table;

a power source;

first and second drive connection mechanisms connected to said sheet advancing belts from said power source;

said first drive mechanism arranged to drive said feed belts at a variable speed feed rate for advancing sheets separated from each other;

said second drive mechanism arranged to drive said feed belts at a slower constant feed rate for advancing sheets overlapped with each other in a stream;

first and second drive releases for said respective first and second drive mechanisms, operable to engage or release said first and second drive mechanisms alternately;

said stock board having a front end adjacent said feed table, and a rear end displaced from said feed table;

tracks above said stock board, longitudinally arranged between said front end and said rear end of said stock board;

said sheet feeder head being movably mounted on said tracks;

a sheet feeder head position actuator operably connected to said sheet feeder head for moving said sheet feeder head to different positions at said front end for front feed of sheets, and at said rear end for rear feed of sheets; and a movable drive connection from said power source to said sheet feeder head for enabling drive of said sheet pickup advancers in said different positions.

14. The printing press feeder in claim 13 wherein said sheet feeder head position actuator comprises at least one endless drive element attached to said sheet feeder head, and a head position actuator connected to said endless drive element.

15. The printing press feeder in claim 14 wherein said sheet feeder head position actuator comprises a pair of chains, and said head movement actuator comprises cooperative sprockets and a rotational knob.

16. The printing press feeder in claim 13 wherein said sheet feeder head has a plurality of spaced suction units, said units being vertically up and down shiftable and forwardly-rearwardly shiftable;

a vertical shifter device for said suction units, and a forward-rearward shifter device for said suction units, causing said suction units to move in a cycle to be shifted down to pick up a sheet, be shifted up and forwardly to advance the sheet, and be shifted rearwardly and down to pick up the next sheet, and said movable drive connection being connected to both said shifter devices through said movable drive connection.

17. The printing press feeder in claim 16 wherein said vertical shifter is a first cam and said forward-rearward shifter is a second cam.

* * * * *

UNITED STATES PATENT AND TRADEMARK OFFICE

CERTIFICATE OF CORRECTION

PATENT NO. : 5,404,806
DATED : April 11, 1995
INVENTOR(S) : Arthur E. Proctor

It is certified that error appears in the above-indentified patent and that said Letters Patent is hereby corrected as shown below:

Column 1, line 26;
"shack" should be -- stack --;

Column 1, line 62;
"tile" should be -- the --;

Column 1, line 64;
"tile" should be -- the --;

Column 5, line 31;
"94';" should be -- 94', --;

Column 8, line 32;
"(Fig. 21)and" should be -- (Fig. 21) and --;

UNITED STATES PATENT AND TRADEMARK OFFICE

CERTIFICATE OF CORRECTION

PATENT NO. : 5,404,806

DATED : April 11, 1995

INVENTOR(S) : Arthur E. Proctor

It is certified that error appears in the above-indentified patent and that said Letters Patent is hereby corrected as shown below:

Column 10, line 45;
"carriage." should be -- carriage, --;

Column 11, line 60;
"beating" should be -- bearing --.

Signed and Sealed this

Nineteenth Day of September, 1995

*Attest:*

Bruce Lehman

BRUCE LEHMAN

*Attesting Officer*

*Commissioner of Patents and Trademarks*